US009609729B2

(12) United States Patent
Griffin et al.

(10) Patent No.: US 9,609,729 B2
(45) Date of Patent: Mar. 28, 2017

(54) X-RAY CELLS AND OTHER COMPONENTS HAVING GAS CELLS WITH THERMALLY-INDUCED DENSITY GRADIENTS

(71) Applicant: Raytheon Company, Waltham, MA (US)

(72) Inventors: Eric J. Griffin, Rancho Palos Verdes, CA (US); Kalin Spariosu, Thousand Oaks, CA (US); David A. Vasquez, Gardena, CA (US)

(73) Assignee: RAYTHEON COMPANY, Waltham, MA (US)

( * ) Notice: Subject to any disclaimer, the term of this patent is extended or adjusted under 35 U.S.C. 154(b) by 443 days.

(21) Appl. No.: 13/866,908

(22) Filed: Apr. 19, 2013

(65) Prior Publication Data

US 2014/0314210 A1 Oct. 23, 2014

(51) Int. Cl.
*H05G 2/00* (2006.01)

(52) U.S. Cl.
CPC ..... *H05G 2/003* (2013.01); *H05G 2/008* (2013.01)

(58) Field of Classification Search
CPC ..... H05G 2/003; H05G 2/008
USPC ..... 378/119
See application file for complete search history.

(56) References Cited

U.S. PATENT DOCUMENTS 4,866,517 A * 9/1989 Mochizuki et al. ..... 378/119
5,487,078 A 1/1996 Rhodes et al.
5,577,092 A * 11/1996 Kublak et al. ..... 378/119
5,991,360 A * 11/1999 Matsui ..... B82Y 10/00 378/119
6,285,743 B1 * 9/2001 Kondo et al. ..... 378/119
6,320,937 B1 * 11/2001 Mochizuki ..... 378/143
6,324,255 B1 * 11/2001 Kondo et al. ..... 378/119
6,339,634 B1 * 1/2002 Kandaka et al. ..... 378/119
6,504,903 B1 * 1/2003 Kondo ..... B82Y 10/00 378/119
6,760,406 B2 * 7/2004 Hertz et al. ..... 378/119
6,924,600 B2 * 8/2005 Mochizuki ..... 315/111.21
6,968,038 B2 * 11/2005 Nam ..... G01N 23/20075 378/122

(Continued)

OTHER PUBLICATIONS

H. Fiedorowicz and A. Bartnik, "X-ray laser emission from a laser-irradiated gas puff target," Bulletin of the Polish Academy of Sciences, Technical Sciences, vol. 53, No. 2, 2005, p. 103-111.*

(Continued)

*Primary Examiner* — Allen C. Ho

(57) ABSTRACT

A method includes creating a gas flow in a gas cell and cooling a portion of the gas flow to create a thermally-induced temperature gradient in the gas flow. The method also includes directing at least one laser beam through at least a portion of the gas flow with the thermally-induced temperature gradient. The gas flow can be directed axially along a length of the gas cell or transverse to the length of the gas cell, and the at least one laser beam can be directed axially along the length of the gas cell through at least the portion of the gas flow. The gas flow may represent a first gas flow, and the method may further include creating a second gas flow in the gas cell and cooling a portion of the second gas flow to create a thermally-induced temperature gradient in the second gas flow.

20 Claims, 12 Drawing Sheets

(56) References Cited

U.S. PATENT DOCUMENTS

| | | | | |
|---|---|---|---|---|
| 6,998,620 | B2 * | 2/2006 | Schriever | 250/372 |
| 7,016,390 | B2 * | 3/2006 | Rhodes | H05G 2/008 372/5 |
| 7,145,987 | B2 * | 12/2006 | Shiraishi | G03F 7/70033 378/119 |
| 7,729,403 | B2 | 6/2010 | Rocca et al. | |
| 8,009,350 | B2 * | 8/2011 | Kim | G02F 1/353 359/328 |
| 8,093,571 | B2 * | 1/2012 | Endo et al. | 250/504 R |
| 8,462,824 | B2 * | 6/2013 | Popmintchev et al. | 372/21 |
| 8,525,138 | B2 * | 9/2013 | Smith et al. | 250/503.1 |
| 8,610,434 | B2 * | 12/2013 | Heiss | F25B 9/02 324/300 |
| 9,001,968 | B2 * | 4/2015 | Kugland | G21K 1/06 378/82 |
| 9,008,270 | B2 * | 4/2015 | Hasegawa et al. | 378/80 |
| 2010/0078580 | A1 | 4/2010 | Endo et al. | |
| 2011/0007772 | A1 | 1/2011 | Popmintchev et al. | |

OTHER PUBLICATIONS

Amnon Yariv, Optical Electronics, third edition (New York: Holt, Rinehart and Winston, Inc., 1985), 123-226.*

International Search Report and Written Opinion dated Nov. 28, 2014 in connection with International Application No. PCT/US2014/016954; 10 pages.

Fiedorowicz, et al.; "X-Ray Generation from Nd Laser-Irradiated Gas Puff Targets"; Proceedings of SPIE; vol. 2015; Feb. 1, 1994; 7 pages.

* cited by examiner

X-RAY CELLS AND OTHER COMPONENTS HAVING GAS CELLS WITH THERMALLY-INDUCED DENSITY GRADIENTS

TECHNICAL FIELD

This disclosure is directed generally to gas cells. More specifically, this disclosure relates to X-ray cells and other components having gas cells with thermally-induced density gradients.

BACKGROUND

X-rays can be generated by directing ultra-fast, high-power laser pulses onto one or more noble gases, such as helium. Simply directing laser pulses onto a noble gas typically results in highly divergent X-rays, meaning the X-rays travel in scattered directions. To generate a collimated beam in which X-rays travel in substantially the same direction, laser pulses are typically directed onto noble gas within a reflective tube.

In some approaches, gas is pumped at very low pressure into a reflective tube. Unfortunately, these approaches often result in lower-energy X-ray outputs, which typically cannot propagate significant distances through the atmosphere. Higher-energy X-ray outputs can be achieved by pumping gas at higher pressures into a reflective tube. However, these approaches typically require a higher flow rate of gas from one or more gas canisters. In various military and commercial applications, it is not possible or desirable to use a large amount of space for storing gas canisters.

SUMMARY

This disclosure provides X-ray cells and other components having gas cells with thermally-induced density gradients.

In a first embodiment, a method includes creating a gas flow in a gas cell and cooling a portion of the gas flow to create a thermally-induced temperature gradient in the gas flow. The method also includes directing at least one laser beam through at least a portion of the gas flow with the thermally-induced temperature gradient.

In a second embodiment, an apparatus includes a gas cell configured to receive a gas flow. The apparatus also includes a cryocooler configured to cool a portion of the gas flow and create a thermally-induced temperature gradient in the gas flow. The gas cell is further configured to receive at least one laser beam that passes through at least a portion of the gas flow with the thermally-induced temperature gradient.

In a third embodiment, a system includes at least one laser configured to generate at least one laser beam and an X-ray cell configured to receive the at least one laser beam and generate X-rays. The X-ray cell includes a gas cell configured to receive a gas flow and a cryocooler configured to cool a portion of the gas flow and create a thermally-induced temperature gradient in the gas flow. The system is configured to pass the at least one laser beam through at least a portion of the gas flow with the thermally-induced temperature gradient.

Other technical features may be readily apparent to one skilled in the art from the following figures, descriptions, and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 14, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

Figure 1:
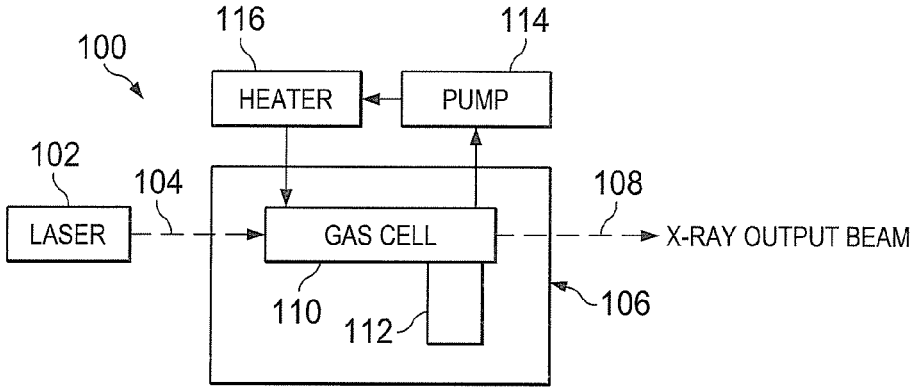
FIG. 1 illustrates an example system using a gas cell with a thermally-induced density gradient in accordance with this disclosure.

FIG. 1 illustrates an example system 100 using a gas cell 110 with a thermally-induced density gradient in accordance with this disclosure. In this example, the system 100 uses the gas cell 110 with the thermally-induced density gradient to generate X-rays. However, a gas cell 110 with a thermally-induced density gradient can be used in any other suitable manner.

As shown in FIG. 1, the system 100 includes at least one laser 102 configured to generate at least one output laser beam 104. An X-ray cell 106 receives the output beam(s) 104, where laser pulses in the beam(s) 104 interact with one or more gases (referred to singularly or collectively as "gas") to generate an X-ray output beam 108. Any suitable gas can be used, such as one or more noble gases like helium.

Each laser 102 includes any suitable structure configured to generate laser pulses, such as a long-wave infrared (LWIR) laser. In particular embodiments, the laser 102 is able to generate laser pulses having a power density of about $10^{14}$ W/cm$^2$ to about $10^{15}$ W/cm$^2$ or more (although any other suitable power level could be used). Each output laser beam 104 represents any suitable laser beam having pulses suitable for interacting with gas to generate X-rays. The X-ray output beam 108 represents any suitable X-ray beam, such as a high-power coherent X-ray beam.

In this example, the X-ray cell 106 includes a gas cell 110. The gas cell 110 generally represents an elongated or other structure containing gas. Laser pulses in the output laser beam(s) 104 travel through at least a portion of the gas cell 110 to interact with the gas and generate X-rays. Moreover, the gas moves along at least part of the gas cell 110 to create a gas flow, and the gas has a thermally-induced temperature gradient. The gas cell 110 includes any suitable structure through which gas can flow and interact with laser pulses. Note that a gas flow can be created in the gas cell 110 in any suitable direction(s), such as in an axial direction (along the length axis of the gas cell 110) or in a transverse direction (perpendicular to the length axis of the gas cell 110).

At least one cryocooler 112 cools the gas in the gas cell 110 at one or more locations. In this example, a single cryocooler 112 is located at one end of the gas cell 110, although one or more cryocoolers 112 could be placed at any other or additional location(s), such as in the center of the gas cell 110. The location(s) of the cryocooler(s) 112 could vary depending on various factors, such as where gas is injected into the gas cell 110. Also, the temperature to which a cryocooler 112 cools can vary depending on the application and the desired thermal gradient of the gas in the gas cell 110. As specific examples, a cryocooler 112 could cool gas at about 300K to about 60K for a thermal gradient of about 5:1 or to around 10K for a thermal gradient of about 30:1. Each cryocooler 112 includes any suitable structure for cooling to cryogenic or other very-low temperatures. Example types of cryocoolers 112 include single stage, pour-fill, and multi-stage cryocoolers. Specific examples of cryocoolers include cryocoolers from CRYOMECH, INC. and in-line compact cryocoolers from RAYTHEON COMPANY.

A gas flow within the gas cell 110 can be created using a pump 114. In this example, the pump 114 pumps gas from at least one "cold" section of the gas cell 110 (where the gas has a lower temperature due to the cryocooler 112) towards at least one "warm" section of the gas cell 110 (where the gas has a higher temperature). The pump 114 includes any suitable structure for pumping gas, such as a micro-pump. The flow rate supported by the pump 114 can vary depending on several factors, such as the anticipated load imparted by laser-induced plasma, heat path leakages, and gas cell recirculation. In some embodiments, the thermal gradient of a gas flow within the gas cell 110 is re-established between laser pulses in the output laser beam(s) 104, and the flow rate of the pump 114 can be controlled based on the timing between the laser pulses. In particular embodiments, the steady-state density gradient of the gas flow can be established with a minimal pressure drop along the length of the gas cell 110 (such as 1 PSI or less) at a flow rate in the range of conventional micro-pumps.

At least one heater 116 can optionally be used to heat the gas prior to the gas entering the "warm" section of the gas cell 110. The heater 116 includes any suitable structure for heating gas. Note that the use of the heater 116 is optional, and the heating of the gas could occur in other ways (such as heating to room temperature or other temperature via heat transfer from the ambient environment). Also note that the extraction of cooled gas from the gas cell 110 and the providing of warmed gas to the gas cell 110 are for illustration only, and an opposite flow could be used. In those embodiments, the extraction of warm gas can occur from the "warm" section of the gas cell 110, and the gas could be pre-cooled before entering the "cold" section of the gas cell 110.

The use of the cryocooler(s) 112 to cool gas within the gas cell 110 (and optionally the heating or pre-cooling of gas entering the gas cell 110) leads to the creation of a density gradient in the gas. The system 100 uses the density gradient of the gas in the gas cell 110 to generate the X-rays in the X-ray output beam 108. However, the density gradient in the gas is generated in FIG. 1 thermally, rather than via pressure.

Thermally-induced density gradients in a gas cell have various advantages over pressure-induced density gradients. For example, thermally-induced density gradients can be used to generate higher-energy X-rays, such as an X-ray output beam 108 of at least 10 keV (although higher or lower energy levels could be generated). These higher-energy X-rays can propagate significant distances through the atmosphere. Moreover, these higher-energy X-rays can be obtained without requiring high pressures in the gas cell 110 (although higher pressures can still be used).

The use of higher pressures often complicates conventional closed-loop systems and requires large reservoirs of gas for conventional open-loop systems. Moreover, the use of higher-pressure helium makes sealing and containment issues more problematic, and it is often more difficult to tailor a pressure gradient in a gas cell. Further, in systems using high-pressure gas, the internal geometry of the gas cell often needs to be designed for a specific laser performance. There is often an inherent coupling between the gas cell's shape affecting both laser spatial performance and laser performance based on the density gradient and the density gradient established by flow through the gas cell shape. In addition, higher pressures and flow rates often result in dynamic pressure losses and corresponding density drops.

The use of thermally-induced density gradients can help to reduce or avoid at least some of these problems. For example, thermally-induced density gradients can be achieved with relatively low mass flow rates and velocities of the gas. Also, a wide range of temperature gradients can be established with different types of cryocoolers. For instance, smaller density gradients (such as up to about 5:1) could be achieved with higher-temperature cryocoolers. Medium density gradients (such as about 5:1 to about 10:1) could be achieved with larger cryocooler engines or pour-fill cryocoolers. Higher-density gradients (such as up to about 30:1 or higher) could be achieved with two-stage cryocoolers and a transverse flow arrangement. Of course, these are for illustration only. Further, the density gradient along each laser beam's path can be tailored independently of the gas cell's inner diameter, and adjusting the wall thickness of the gas cell 110 may not change the inner flow characteristics of the gas cell 110.

Other advantages could include operating the gas cell 110 with lower gas pressures and providing multiple flow arrangements for differing applications. For example, lower-power systems could use the axial gas flow(s) described above, and higher-power systems could use the transverse gas flow described above (although this need not be the case). Low-flow low-pressure systems implemented in this manner can utilize tactically-deployable cryogenic coolers, which permit the use of deployable X-ray systems that can be used in a wide variety of military and commercial applications. Additional details regarding the use of a gas cell with a thermally-induced temperature gradient are provided below.

Note that energy imparted into the gas in the gas cell 110 by the output laser beam(s) 104 results in local heating of the gas. The flow rate of the pump 114 and the clamping temperature of the cryocooler 112 can be selected or adjusted to maintain the desired temperature gradient in the gas cell 110. The thermally-induced gradient within the gas cell 110 can be tailored with far greater flexibility than a pressure-induced gradient. Also, the wall thickness of the gas cell 110 can vary in cross-section to create a desired variable thermal impedance. Gradients following linear, quadratic, or other non-linear profiles can be constructed by varying the relative impedance along the length of the gas cell 110. The cryogenically-clamped region of the gas cell 110 can also be varied to provide broader or narrower regions of peak density.

Although FIG. 1 illustrates one example of a system 100 using a gas cell 110 with a thermally-induced density gradient, various changes may be made to FIG. 1. For example, various arrangements of the gas cell 110 and the cryocooler 112 can be used, including those described below. Also, as noted above, the gas cell 110 and the cryocooler 112 could be used to facilitate the generation of X-rays, but these components could be used in other applications. For instance, these components could be used in applications where light passes through a clear aperture of gas with an established density gradient. One such application is in Raman cells employing density gradients to achieve high effective pressures without requiring pressurization.

FIGS. 2 through 5 illustrate a first example device 200 with a gas cell 110 having a thermally-induced density gradient in accordance with this disclosure. The device 200 could, for example, be used as the X-ray cell 106 in the system 100 of FIG. 1 or in any other suitable system.

Figure 2:
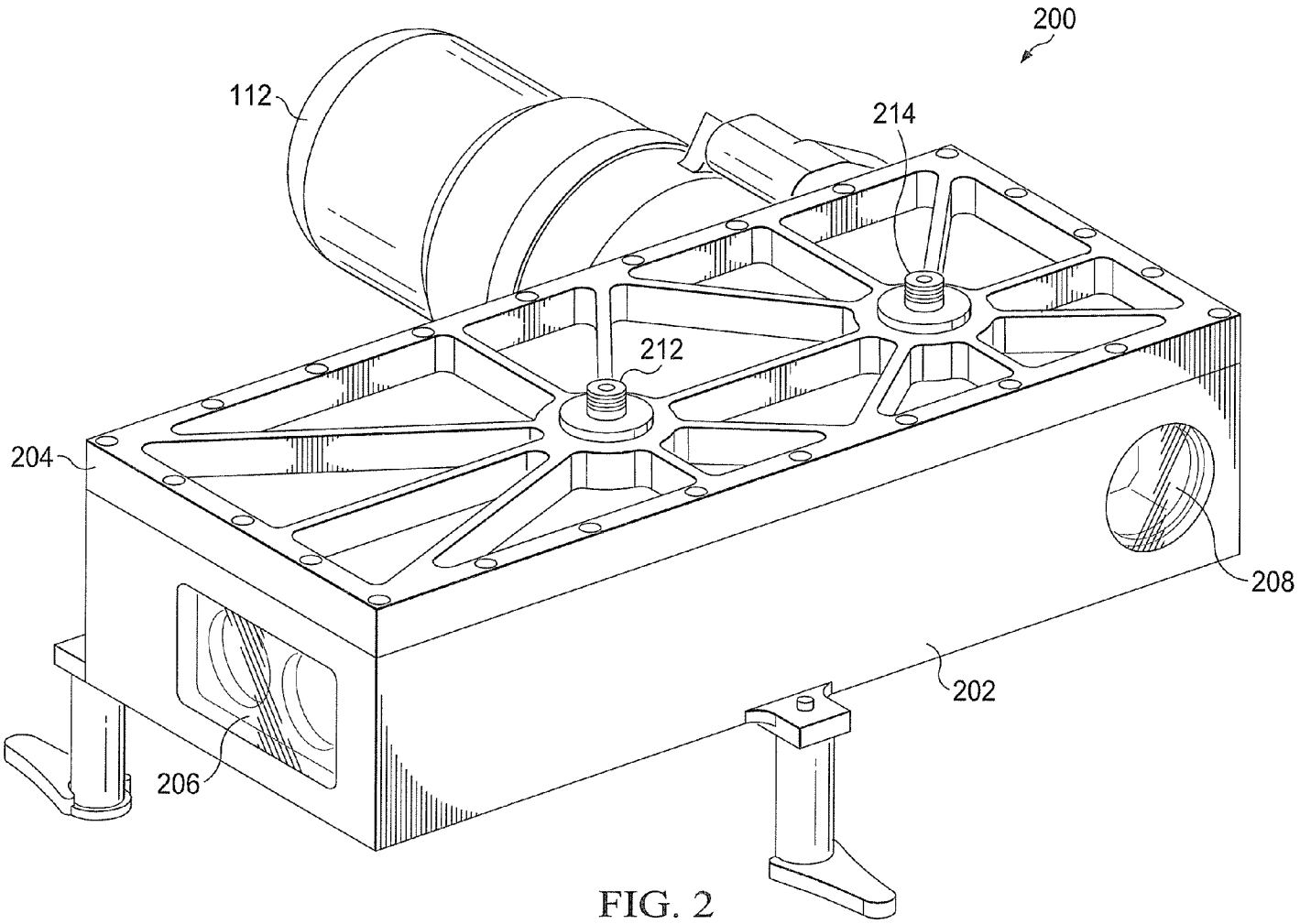
FIGS. 2 through 5 illustrate a first example device with a gas cell having a thermally-induced density gradient in accordance with this disclosure.
Figure 3:
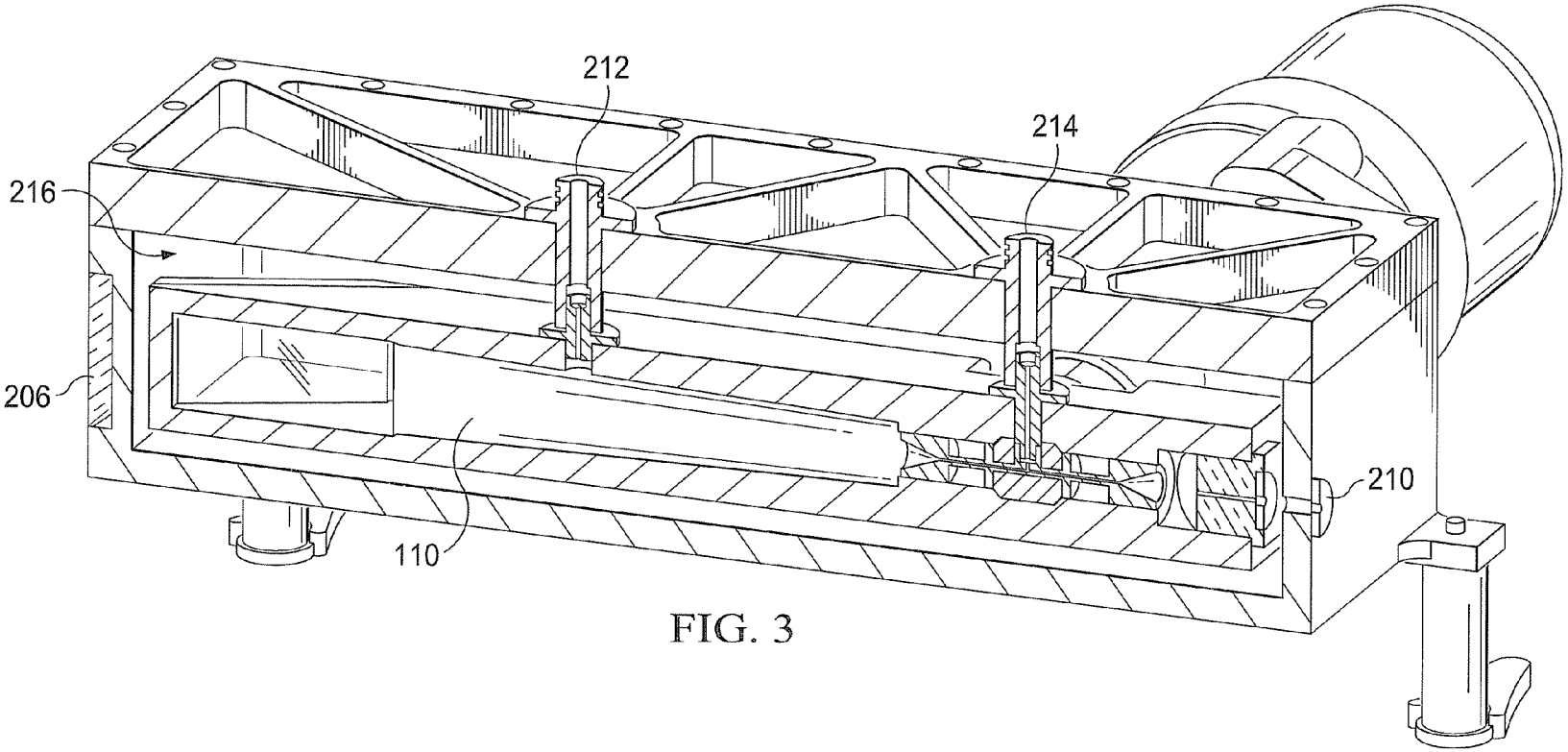

As shown in FIGS. 2 and 3, the device 200 includes the cryocooler 112, which in this example is mounted at or near the end of the gas cell 110. The device 200 also includes a housing 202 and a cover 204. The housing 202 represents any suitable structure configured to hold, encase, or otherwise support other components of the device 200, including the gas cell 110. The housing 202 can have any suitable size, shape, and dimensions. The housing 202 can also be formed from any suitable material(s) (such as metal or plastic) and in any suitable manner. The cover 204 represents any suitable structure configured to be removably or permanently coupled to the housing 202. The cover 204 could have any suitable size, shape, and dimensions. The cover 204 can also be formed from any suitable material(s) (such as metal or plastic) and in any suitable manner. While shown as covering the entire top of the housing 202, the cover 204 could cover all or a portion of any suitable surface(s) of the housing 202.

The housing 202 includes a laser input 206, a laser output 208, and an X-ray output 210. The laser input 206 represents an area of the housing 202 through which one or more laser beams 104 can pass prior to entering the gas cell 110. The laser output 208 represents an area of the housing 202 through which the laser beam(s) 104 can pass after exiting the gas cell 110. The X-ray output 210 represents an area of the housing 202 through which the X-ray output beam 108 can pass. Each laser input 206 and laser output 208 and 210 includes any suitable structure through which an input or output signal can pass. For instance, the laser input 206 and laser output 208 could include windows formed from material(s) substantially transparent to laser light, and the X-ray output 210 could include a window formed from material(s) substantially transparent to X-rays (such as beryllium).

The housing 202 also include a gas inlet 212 and a gas outlet 214. The gas inlet 212 represents a port that receives gas to be provided to the gas cell 110. The gas outlet 214 represents a port that receives gas from the gas cell 110. The gas inlet 212 could provide warm gas to the gas cell 110, such as warm gas at 300K or other temperature received from the pump 114 and the heater 116. The gas outlet 214 could receive cold gas from the gas cell 110, such as cold gas that has been cooled by the cryocooler 112. As noted above, however, the gas flow in the gas cell 110 could be reversed. Each inlet 212 and outlet 214 includes any suitable structure for providing fluid access to a gas cell.

Within the housing 202 is an evacuated dewar 216 and the gas cell 110. The evacuated dewar 216 represents a volume of space around the gas cell 110 that has been evacuated of air to form a vacuum, which can help to thermally isolate the gas cell 110. The use of a vacuum around the gas cell 110 helps to avoid parasitic heat loss from the cryogenically-cooled gas and establish a sufficient density gradient within the gas cell 110. The dewar 216 represents any suitable space that can contain a vacuum.

Figure 4:
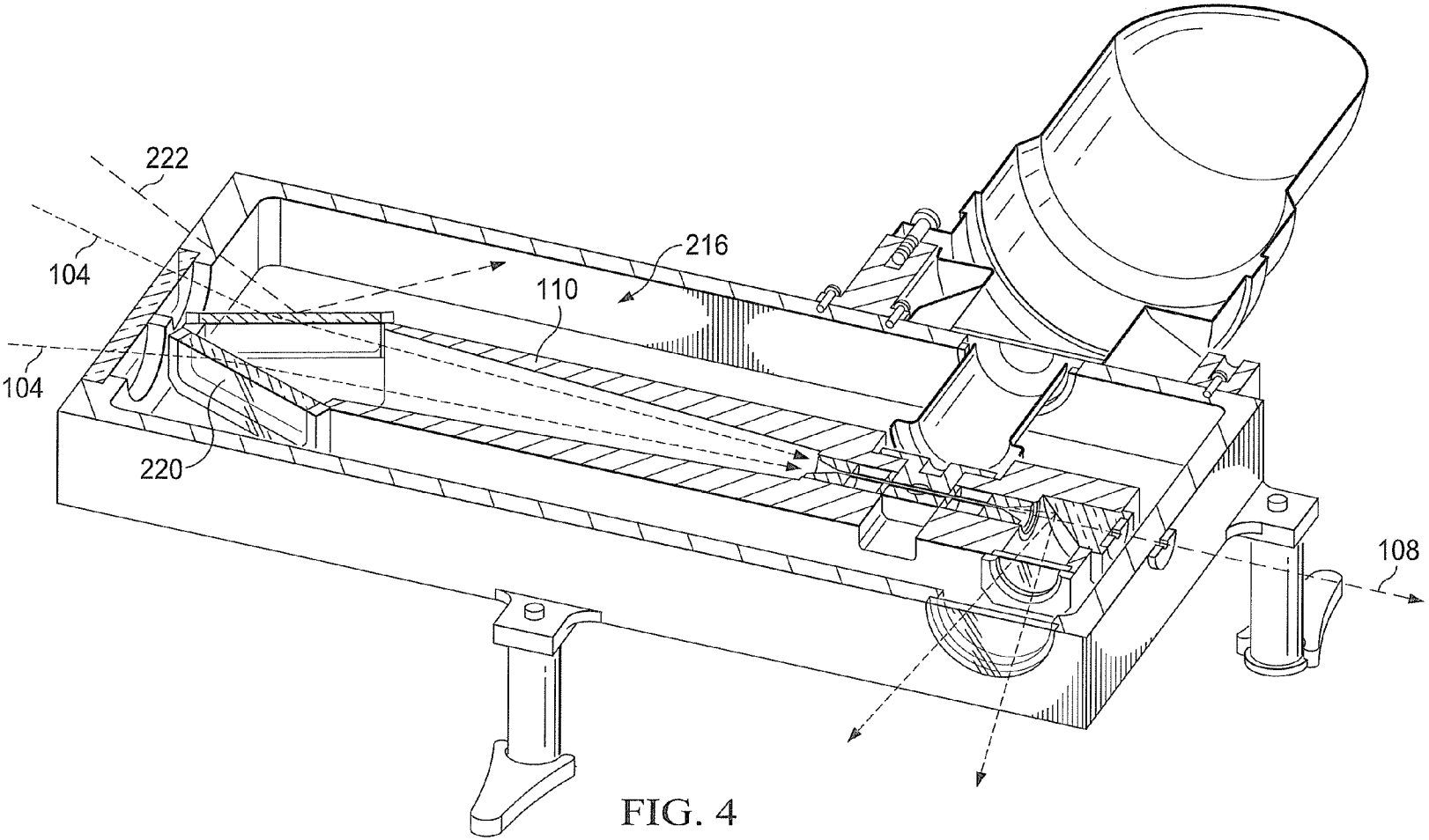

The gas cell 110 in this example represents an elongated space that can be filled with gas, such as one or more noble gases. In particular embodiments, the gas cell 110 can be filled with helium. As shown in FIG. 4, the device 200 operates by providing one or more output laser beams 104 axially down the length of the gas cell 110. Because the gas in the gas cell 110 has different temperatures along the length of the gas cell 110, this creates a density gradient along the length of the gas cell 110. As a result, laser pulses in the output laser beam(s) 104 generate X-rays via interaction with the gas in the gas cell 110.

Brewster's windows 220 are used to pass polarized radiation (the output laser beam(s) 104) into the gas cell 110, and one or two Brewster's windows 220 can be used depending on whether the gas cell 110 is pumped by one or two laser beams 104. Each Brewster's window 220 includes any suitable material(s) substantially transparent to laser light and arranged at an appropriate angle. Optionally, an auto-alignment laser beam 222 can be used to optically verify alignment of each incoming laser beam 104. For example, the auto-alignment laser beam 222 can be reflected off a Brewster's window 220 and provided to an auto-alignment detector (not shown). Measurements from the auto-alignment detector can be used to adjust the angle at which that laser beam 104 is provided into the gas cell 110. Note that a single auto-alignment laser beam 222 is shown here, although an auto-alignment laser beam 222 could be used with each laser beam 104. Also note that the gas cell 110 here, can receive a laser beam 104 on a single side or multiple laser beams 104 on multiple sides. Receiving a single laser beam 104 can help to simplify the optical design of the device 200 and allow a single auto-alignment loop to be used. Receiving multiple laser beams 104 can help to reduce the energy density of each laser beam 104, which simplifies other components in the device 200 since they are handling beams with less energy.

Figure 5:
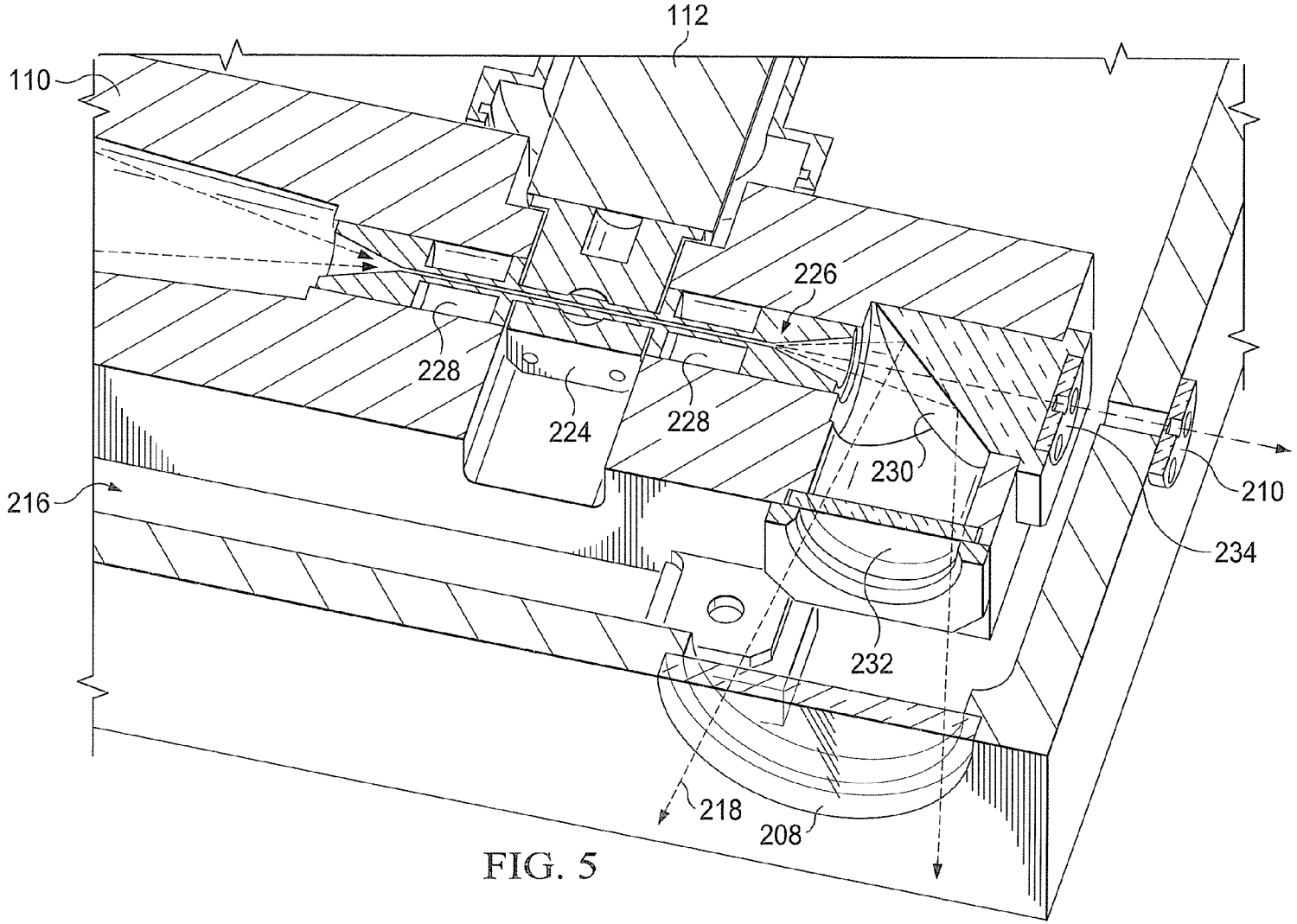
Figure 6:
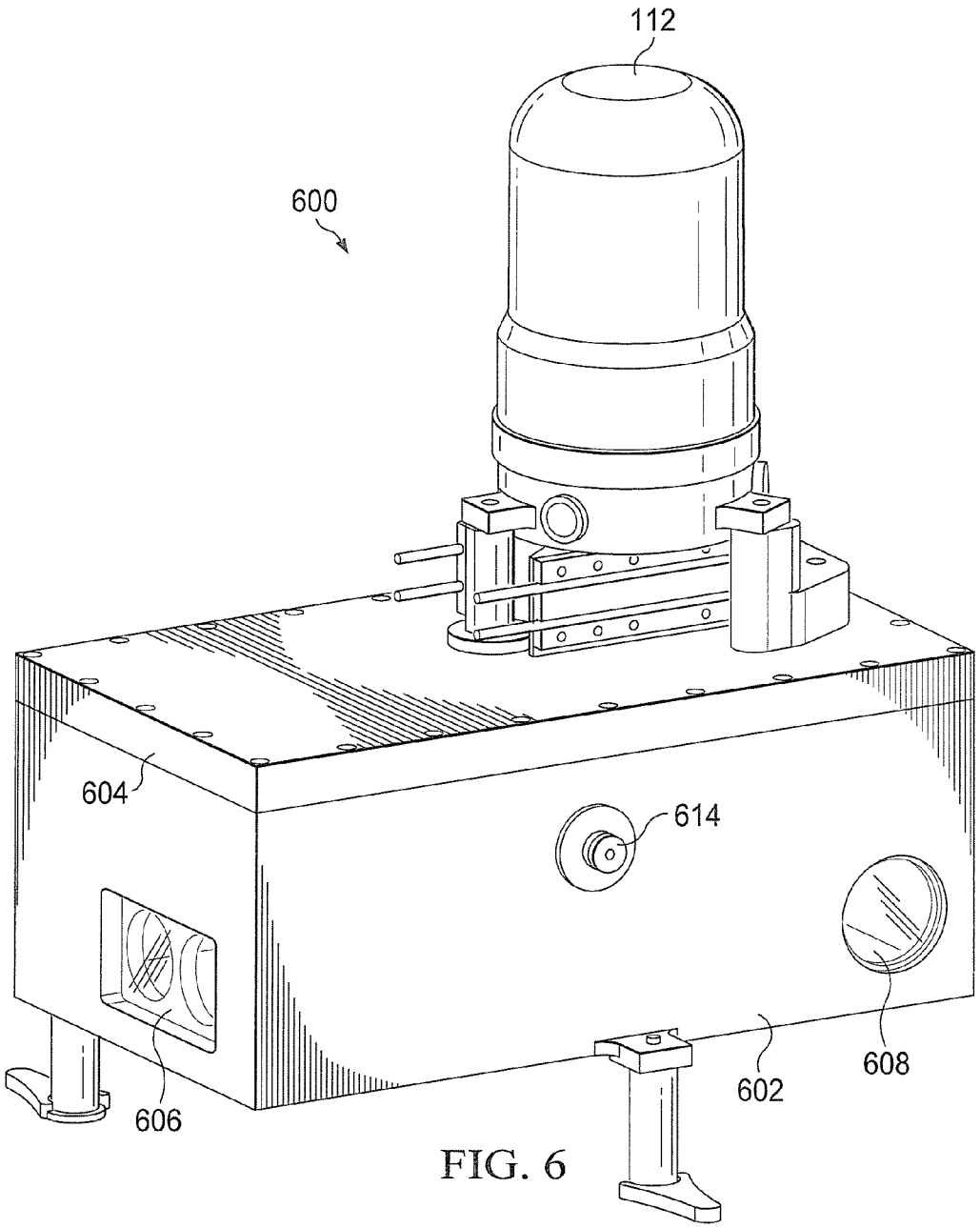
FIGS. 6 through 9 illustrate a second example device with a gas cell having a thermally-induced density gradient in accordance with this disclosure.

As shown in FIG. 5, a cold tip clamp 224 couples the cryocooler 112 to an outlet 226 of the gas cell 110. The cold tip clamp 224 represents any suitable structure for coupling a cryocooler 112 to another structure. The cold tip clamp 224 could also be formed from any suitable material(s) (such as titanium or other metal) and in any suitable manner.

The outlet 226 of the gas cell 110 includes a narrow channel through which the laser beams 104, 218 and the X-ray beam 108 can pass. The outlet 226 also defines two vacuum cells 228, one on each side of the cold tip clamp 224. The vacuum cells 228 help to isolate the portion of the outlet 226 so the temperature of that portion can be precisely controlled by the cryocooler 112. The outlet 226 includes any suitable structure for providing a path for one or more laser beams 104 and/or X-ray beams 108. The outlet 226 can be formed from any suitable material(s) (such as titanium or other metal) and in any suitable manner.

In some embodiments, significant amounts of energy in the laser beam(s) 104 are transmitted through the gas cell 110. To avoid damage to the X-ray outputs, the bulk of the transmitted laser energy can be redirected. For example, a scraper mirror 230 can reflect the laser energy from the laser beam(s) 104 while allowing the X-rays to pass to the X-ray output 210. The scraper mirror 230 includes any suitable structure for reflecting laser light. In some embodiments, the laser energy is reflected towards an inner window 232 before reaching the laser output 208, where the energy can be dissipated without inducing additional thermal load to the cryocooler 112. The X-rays are transmitted towards an inner window 234 before reaching the X-ray output 210. The inner window 232 could be formed from the same or similar material(s) as the window of the laser output 208, and the inner window 234 could be formed from the same or similar material(s) as the window of the X-ray output 210. In other embodiments, the laser beam(s) 104 could be captured through the scraper mirror 230 and a beam trap. These components can be internally cooled, either passively or through an active, independent cooler.

In this example, the laser beam(s) 104 travel(s) axially through the gas cell 110, and the cryocooler 112 helps to cool the gas within the gas cell 110 to create a thermally-induced density gradient axially along the gas cell 110. The thermally-induced density gradient created in the gas cell 110 allows for a higher-energy X-ray beam 108 to be created without the complications associated with pressure-induced density gradients. For instance, the thermally-induced density gradient can be created at low pressures and gas flow rates, reducing or eliminating the need for gas canisters. The entire system can be enclosed and not require any gas replenishment except as part of periodic maintenance.

FIGS. 6 through 9 illustrate a second example device 600 with a gas cell 110 having a thermally-induced density gradient in accordance with this disclosure. The device 600 could, for example, be used as the X-ray cell 106 in the system 100 of FIG. 1 or in any other suitable system.

The device 600 can include various components from the device 200 described above. For example, the device 600 includes a cryocooler 112 mounted at or near the end of the gas cell 110. The device 600 also includes a housing 602, a cover 604, a laser input 606, a laser output 608, and an X-ray output 610. These components 602-610 could be the same as or similar to the corresponding components 202-210 in FIG. 2. The device 600 further includes a gas outlet 614, which could be the same as or similar to the gas outlet 214 in FIG. 2. A gas inlet (not shown) identical or similar to the gas inlet 212 could be provided at a suitable location in the device 600, such as on a wall of the housing 602 opposite the gas outlet 614. An evacuated dewar 616 can be provided around the gas cell 110. One or more Brewster's windows 620 can be used to direct one or more laser beams 104 into the gas cell 110.

Figure 7:
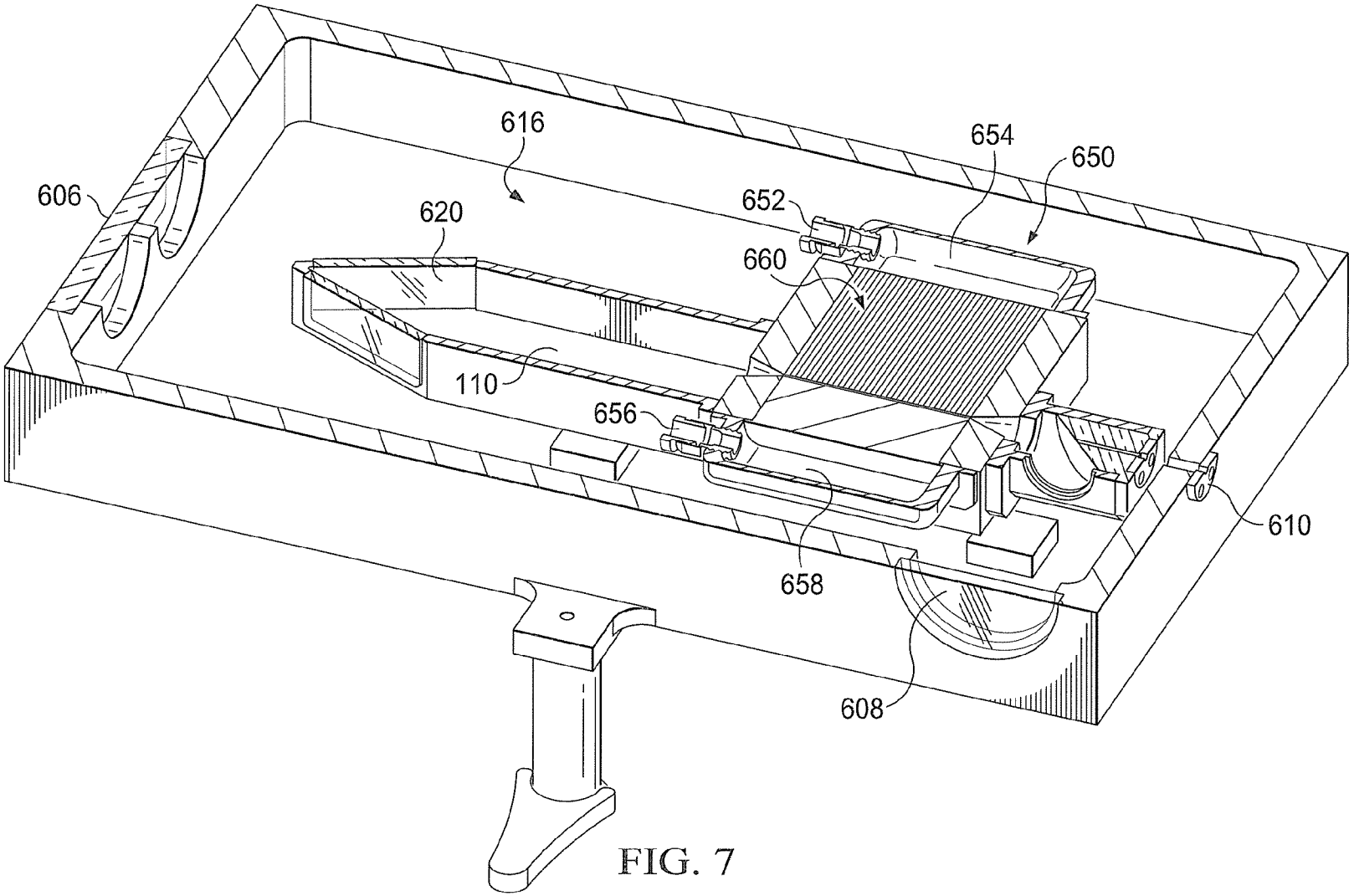
Figure 8:
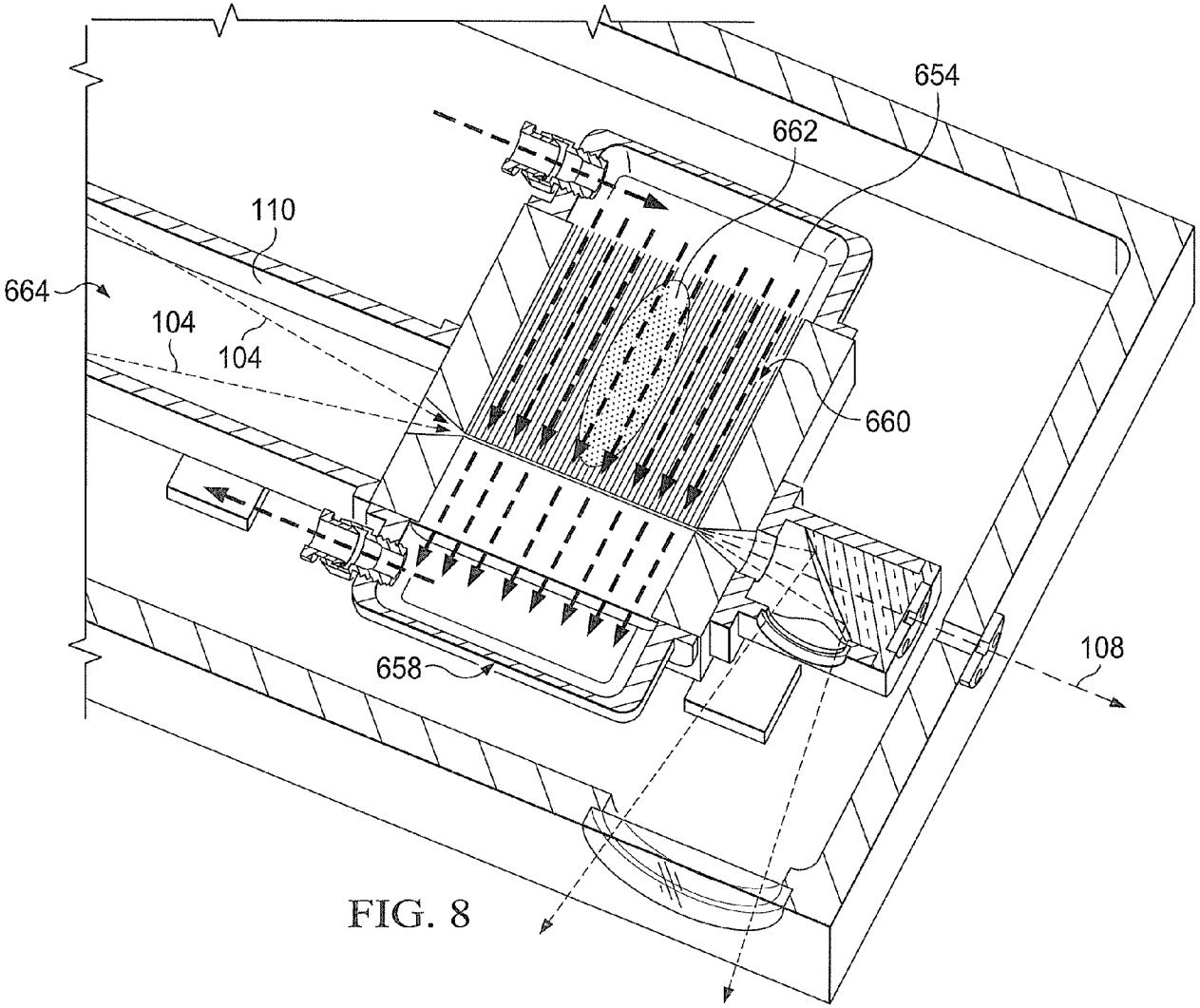

As shown in FIGS. 7 and 8, the device 600 includes a gas manifold structure 650, which creates a gas flow transverse to the long axis of the gas cell 110. A gas inlet 652 provides gas to an input manifold 654, and the gas inlet 652 can be fluidly coupled to the gas inlet in the housing 602. A gas outlet 656 receives gas from an output manifold 658, and the gas outlet 656 can be fluidly coupled to the gas outlet 614 in the housing 602. In some embodiments, the gas inlet 652 can provide pre-cooled gas (such as gas at about 220K to about 250K), and the gas outlet 656 can provide warmed gas (such as gas at about 300K). The pre-cooling can be provided by any suitable structure, and the pre-cooling can help to reduce the cooling capacity of the cryocooler 112.

The manifold structure 650 also includes a heat exchanger 660, which separates the input and output manifolds 654, 658 and is thermally coupled to the cryocooler 112. In particular, a central region 662 of the heat exchanger 660 can be cooled by the cryocooler 112, while the outer regions of the heat exchanger 660 are farther from the cryocooler 112 and therefore at a warmer temperature. As a result, the gas flowing from the gas inlet 652 towards the gas outlet 656 through the central region 662 of the heat exchanger 660 can be cooled more than the gas flowing from the gas inlet 652 towards the gas outlet 656 through the outer regions of the heat exchanger 660. This creates a thermally-induced density gradient in the gas axially along part of the gas cell 110, even though the gas is flowing traverse to the gas cell's long axis. Note that this can effectively create a gas-filled cavity 664 in the gas cell 110 where there is little or no gas flow.

Figure 9:
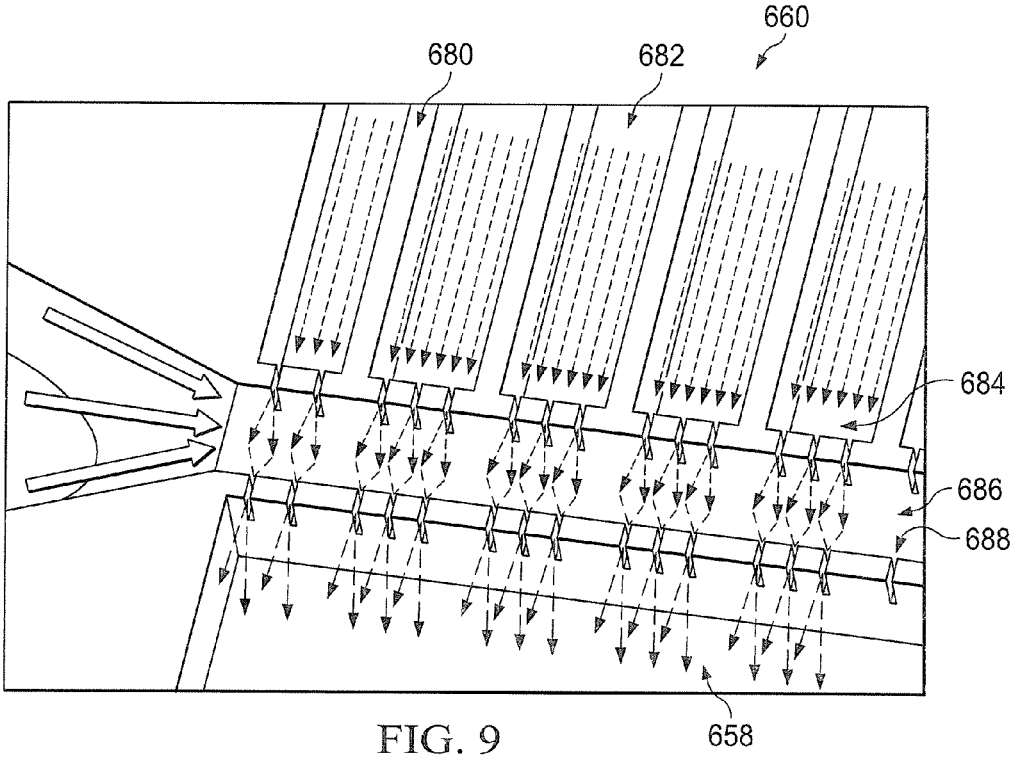

FIG. 9 illustrates an example embodiment of the heat exchanger 660. In this example, the heat exchanger 660 includes fins 680 defining multiple channels 682 through which gas can flow. The fins 680 provide flow control and impede the transfer of heat from one channel to another. The gas passes through slots 684 at the ends of the multiple channels 682. The slots 684 are enlarged here for illustration. The heat exchanger 660 could include any number of slots 684, and each slot 684 could have any suitable size.

The gas exits the slots 684 into an outlet 686 of the gas cell 110. The gas in the outlet 686 has a thermally-induced density gradient, which can lead to the generation of X-rays when the gas is struck by laser pulses. The gas is drawn through slots 688 into the output manifold 658. Again, the slots 688 are enlarged here for illustration, the heat exchanger 660 could include any number of slots 688, and each slot 688 could have any suitable size. In some embodiments, the slots 684, 688 could have a size that is small compared to the laser wavelength entering the cell. Here, the "warm" end of the gas manifold structure 650 can be pulled to vacuum to help prevent gas from flowing from the output manifold 658 into the outlet 686 of the gas cell 110. The heat exchanger 660 here can be formed from any suitable material(s) (such as titanium or other metal) and in any suitable manner.

In this example, one or more laser beams 104 travel axially through the gas cell 110, but the gas flow is transverse to the gas cell's axial length. The cryocooler 112 helps to cool the gas within the transverse flow to create a thermally-induced density gradient axially along part of the length of the gas cell 110. The thermally-induced density gradient created in the gas cell 110 again allows for a higher-energy X-ray beam 108 to be created without the complications associated with pressure-induced density gradients. Moreover, the thermally-induced density gradient in the gas flow can be re-established rapidly, so this embodiment may allow more rapid laser pulses to be used (since the density gradient can be established faster and therefore less time is needed between pulses).

In the embodiments shown in FIGS. 2 through 9, the gas cell 110 supports gas flow in a single direction (axially in FIGS. 2 through 5 and transversely in FIGS. 6 through 9). However, a gas cell 110 could also support the use of multiple gas flows.

Figure 10:
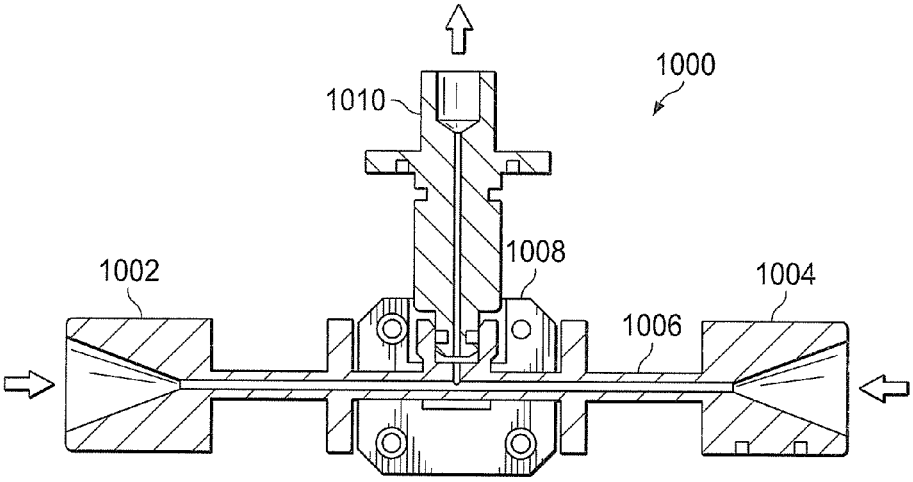
FIG. 10 illustrates a third example device with a gas cell having a thermally-induced density gradient in accordance with this disclosure.

FIG. 10 illustrates a third example device 1000 with a gas cell having a thermally-induced density gradient in accordance with this disclosure. As shown in FIG. 10, warm gas (such as gas at about 300K) is injected into the device 1000 at opposing ends 1002 and 1004 of a gas cell. The gas can be injected in any suitable manner, such as by using the pump 114. The gas travels through piping 1006, and a cold wall 1008 is thermally coupled to a portion of the piping 1006. The cold wall 1008 represents a structure that is cooled by the cryocooler 112. The cold wall 1008 therefore helps to create a thermally-induced density gradient in the gas within the gas cell. The gas exits the gas cell via an outlet 1010.

The inlets 1002 and 1004, piping 1006, and outlet 1010 could be formed from any suitable material(s) (such as titanium or other metal) and in any suitable manner. These components could form part of a single integral unit or represent separate parts that are assembled together. The cold wall 1008 could also be formed from any suitable material(s) (such as copper or other metal) and in any suitable manner.

Note that in the example in FIG. 10, the gas flows are axial and flow from the ends of the gas cell towards a middle of the gas cell. These gas flows are therefore referred to as being axially inward flows. However, axially outward flows could also be used, where the gas flows from the middle of the gas cell towards the ends of the gas cell.

Although FIGS. 2 through 10 illustrate examples of devices with gas cells having thermally-induced density gradients, various changes may be made to FIGS. 2 through 10. For example, the relative sizes, shapes, and dimensions of the components in FIGS. 2 through 10 are for illustration only. Moreover, FIGS. 2 through 10 merely illustrate examples of different ways in which at least one cryocooler can be used to create a thermally-induced density gradient in one or more flows of gas. Any other suitable configuration can be used to create a thermally-induced density gradient in one or more flows of gas.

Figure 11:
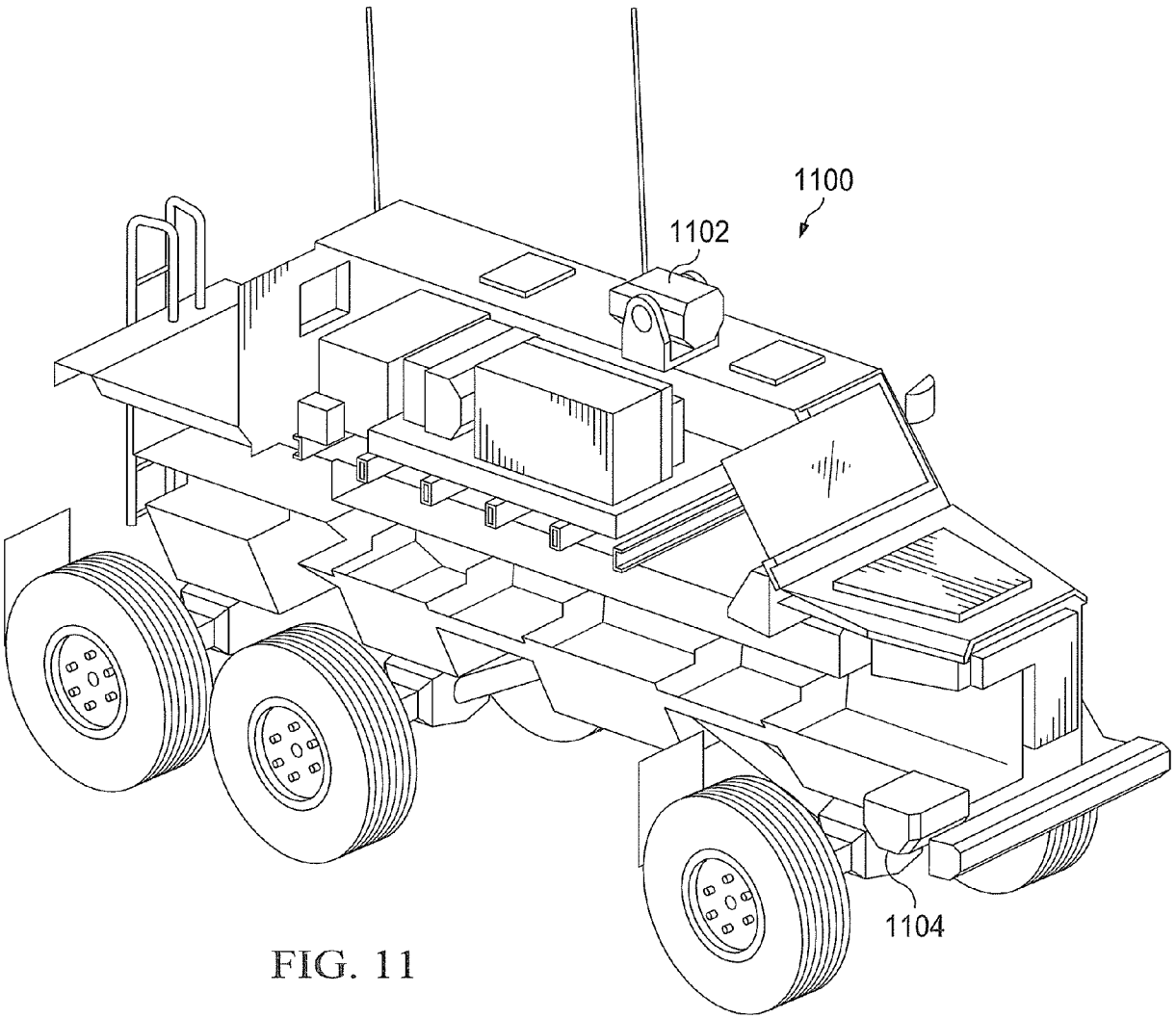
FIGS. 11 through 13 illustrate an example use of a gas cell with a thermally-induced density gradient in accordance with this disclosure.
Figure 12:
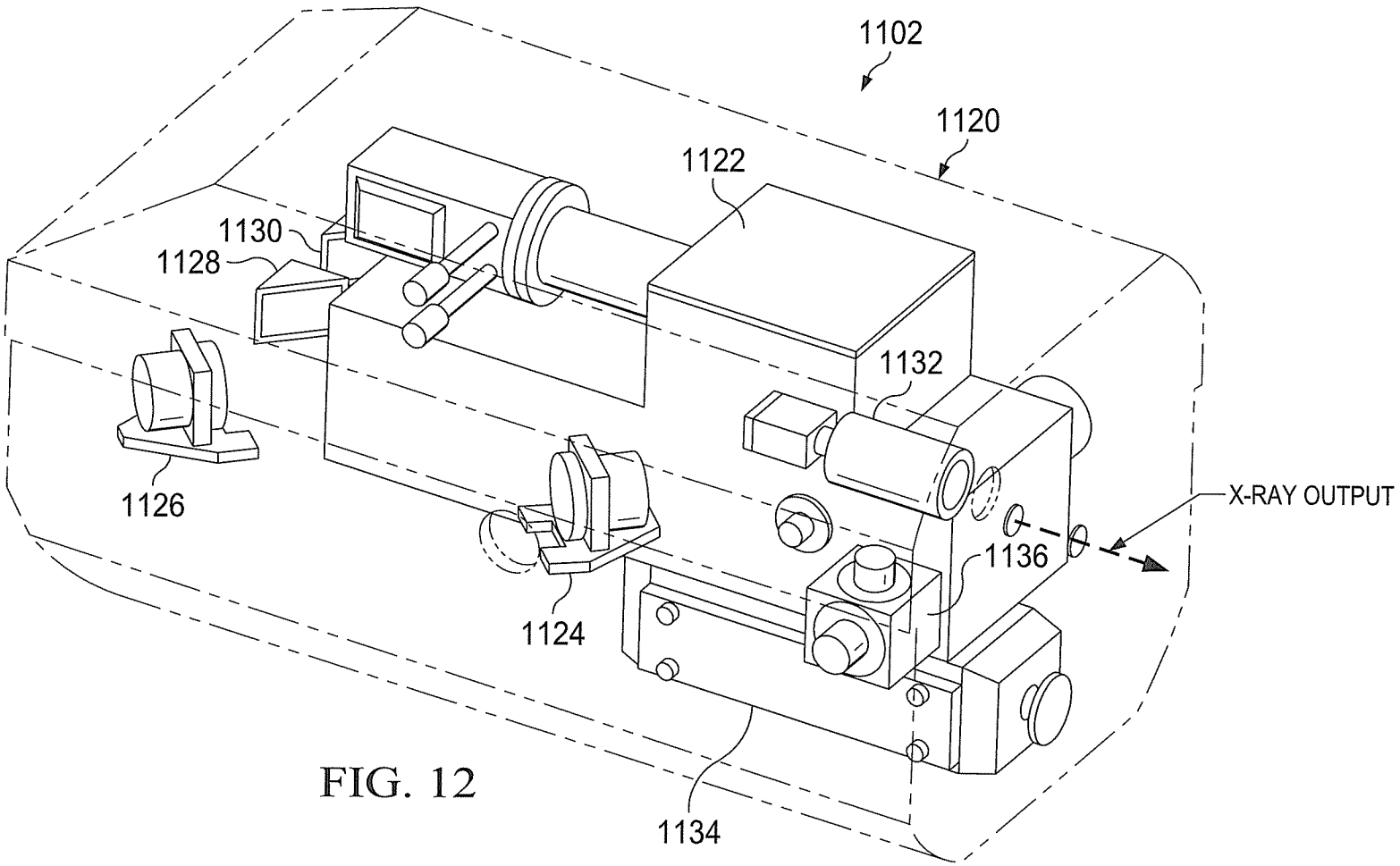
Figure 13:
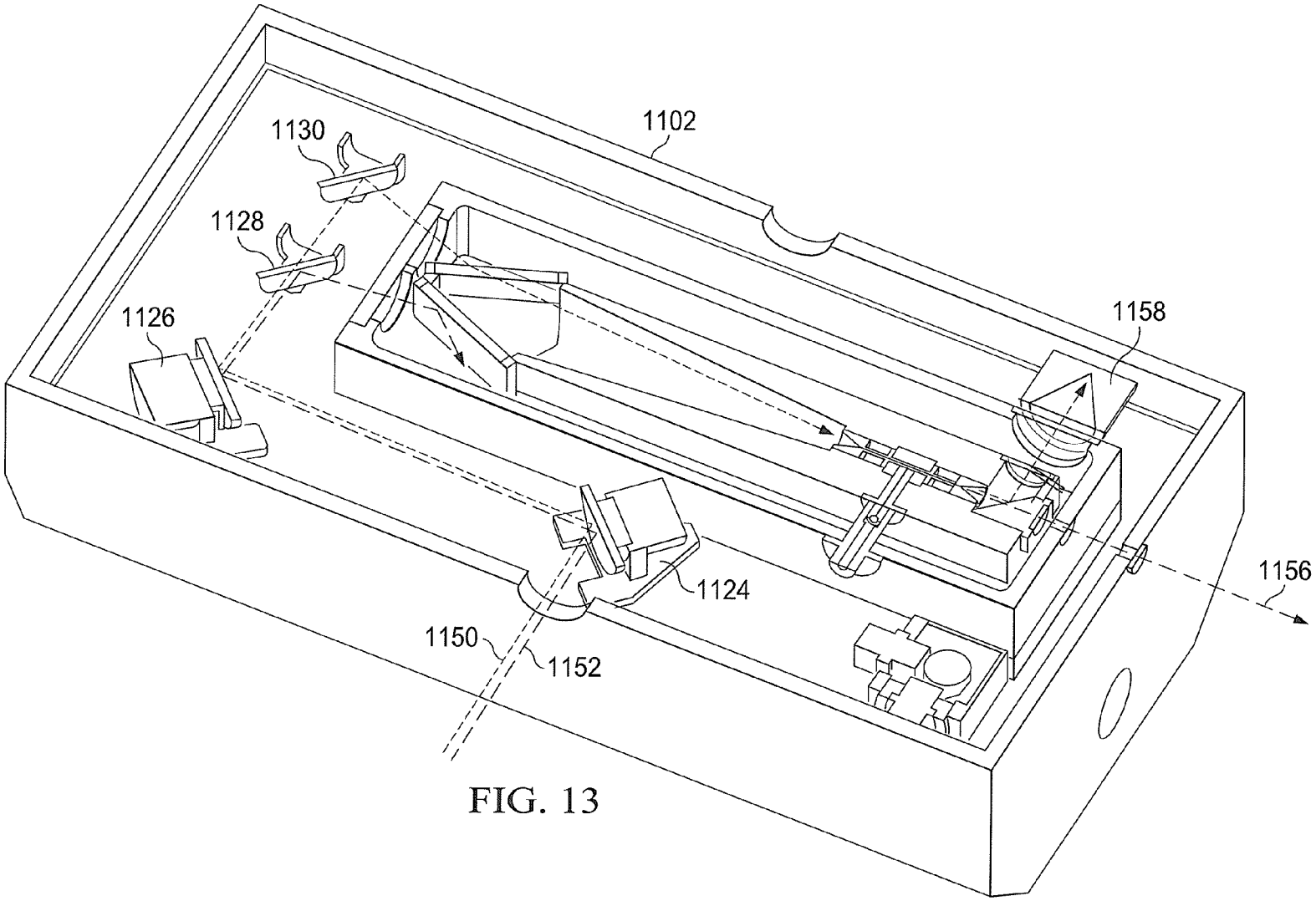

FIGS. 11 through 13 illustrate an example use of a gas cell with a thermally-induced density gradient in accordance with this disclosure. As shown in this example, a vehicle 1100 includes an X-ray generator 1102 and a detector 1104. The X-ray generator 1102 and the detector 1104 here support standoff detection, which refers to the ability to detect certain materials at a distance. For example, the X-ray generator 1102 can be used to direct X-rays ahead of the vehicle 1100, and the detector 1104 could detect reflected rays that have interacted with objects ahead of the vehicle 1100. The reflected rays could be analyzed to detect whether those objects contain one or more materials of interest.

The vehicle 1100 represents any suitable vehicle that uses an X-ray source, such as an armored transport vehicle or other military vehicle. The X-ray generator 1102 includes any suitable source of X-rays and can include any of the devices shown and described above. The X-ray generator 1102 could be mounted to the vehicle 1100 using a gimbal or in any other suitable manner. The detector 1104 includes any suitable structure for detecting and measuring incoming radiation.

An example of the X-ray generator 1102 is shown in FIG. 12. Here, the X-ray generator 1102 includes a housing 1120, which holds, encases, or otherwise supports other components of the X-ray generator 1102. The housing 1120 could represent a ruggedized plastic, metal, or other structure suitable for use in combat or other extreme environments. An X-ray cell 1122 is provided within the housing 1120. The X-ray cell 1122 could represent any of the devices 200, 600, 1000 described above or any other device that operates in the same or similar manner. One or more fast steering mirrors 1124 and 1126 are used to direct one or more incoming laser beams into the X-ray cell 1122 in order to generate an X-ray beam. A beam splitter 1128 and a folding mirror 1130 are used to split an incoming laser beam and an auto-alignment beam.

Additional components are also placed in the housing 1120. This includes a context sensor 1132 and an infrared camera 1134, both of which could represent cameras or other imaging devices identifying the object(s) being scanned with the X-rays. This also includes a gyroscope 1136, which aids in stabilizing the orientation of the X-ray generator 1102.

Example operation of the X-ray generator 1102 is shown in FIG. 13, where an input laser beam 1150 and an auto-alignment laser beam 1152 are directed via the mirrors 1124 and 1126 to the beam splitter 1128, which reflects the auto-alignment beam 1152 into a gas cell and passes the input laser beam 1150. The folding mirror 1130 reflects the input laser beam 1150 into the gas cell. The incoming laser beam 1150 is used to generate an X-ray beam 1156, which is output by the X-ray generator 1102. A beam dump 1158 can receive the input laser beam 1150 after it has interacted with gas in the gas cell.

Although FIGS. 11 through 13 illustrate one example of a use of a gas cell with a thermally-induced density gradient, various changes may be made to FIGS. 11 through 13. For example, a gas cell with a thermally-induced density gradient could be used in any other suitable device or system.

Figure 14:
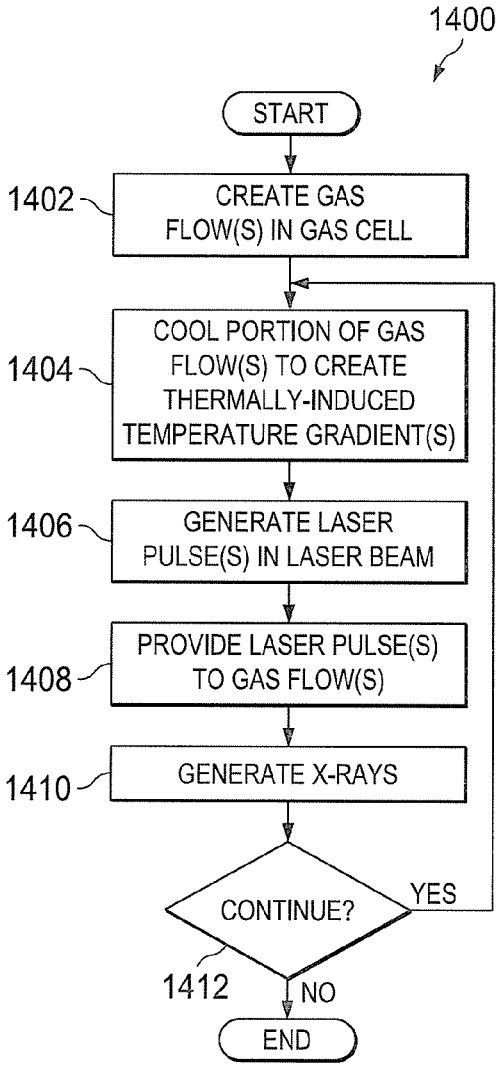
FIG. 14 illustrates an example method for using a gas cell with a thermally-induced density gradient in accordance with this disclosure.

FIG. 14 illustrates an example method 1400 for using a gas cell with a thermally-induced density gradient in accordance with this disclosure. As shown in FIG. 14, at least one gas flow is created in a gas cell at step 1402. This could include, for example, operating the pump 114 to create a flow of gas in the gas cell 110. A single gas flow could be created here, or multiple gas flows could be created. Also, a gas flow could be directed axially along the gas cell 110, transverse across the gas cell 110, or in any other suitable manner. In addition, the gas flow could be from a "cold" section of the gas cell 110 to a "warm" section of the gas cell 110 or vice versa.

One or more portions of the gas flow(s) are cooled to create a thermally-induced temperature gradient in each gas flow at step 1404. This could include, for example, operating the cryocooler 112 to cool a structure around a gas flow. The cooled structure could represent a cold tip clamp 224, heat exchanger 660, cold wall 1008, or any other suitable structure.

At this point, the gas flow(s) with the thermally-induced temperature gradient(s) can be used in any suitable manner. For example, one or more laser pulses in one or more beams can be generated at step 1406, the beam(s) can be provided to the gas flow(s) at step 1408, and X-rays can be generated at step 1410. The X-rays generated can be higher-energy X-rays, even when the gas flow in the gas cell is at low pressure and has a low mass flow rate. Assuming this process continues at step 1412, the process can return to step 1404 to re-establish the thermally-induced temperature gradient(s) in the gas flow(s) and send additional laser pulses through the gas flow(s). The time between laser pulses and the operation of the gas cell 110 can be tuned so that the thermally-induced temperature gradient(s) in between laser pulses.

Although FIG. 14 illustrates one example of a method 1400 for using a gas cell with a thermally-induced density gradient, various changes may be made to FIG. 14. For example, while shown as a series of steps, various steps in FIG. 14 could overlap, occur in parallel, occur in a different order, or occur any number of times. Also, when a gas cell having gas with a thermally-induced density gradient is used in other ways (that do not involve X-ray production), steps 1406-1412 could be omitted.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A method comprising:

creating a gas flow in a gas cell;

cooling a portion of the gas flow using a cryocooler thermally coupled to the gas cell to create a thermally-induced temperature gradient in the gas flow axially along a length of the gas cell, wherein cooling the portion of the gas flow comprises directly cooling the portion of the gas flow in the gas cell using a cold tip of the cryocooler; and directing at least one laser beam axially along the length of the gas cell through at least a portion of the gas flow with the thermally-induced temperature gradient.

2. The method of claim 1, wherein creating the gas flow comprises directing the gas flow axially along the length of the gas cell.

3. The method of claim 1, wherein:

the gas flow comprises a first gas flow; and the method further comprises:

creating a second gas flow in the gas cell; and cooling a portion of the second gas flow to create a thermally-induced temperature gradient in the second gas flow.

4. The method of claim 3, wherein the first gas flow and the second gas flow are directed axially along the length of the gas cell.

5. The method of claim 1, wherein the gas cell has a gas pressure of approximately 6894.76 Pascals or less or one pound per square inch or less.

6. A method comprising:

creating a gas flow in a gas cell;

cooling a portion of the gas flow using a heat exchanger to create a thermally-induced temperature gradient in the gas flow axially along a length of the gas cell, wherein a central portion of the heat exchanger is thermally coupled to a cryocooler; and directing at least one laser beam axially along the length of the gas cell through at least a portion of the gas flow with the thermally-induced temperature gradient.

7. The method of claim 6, wherein creating the gas flow comprises directing the gas flow transversely to the length of the gas cell.

8. The method of claim 6, wherein:

the gas flow comprises a first gas flow; and the method further comprises:

creating a second gas flow in the gas cell; and cooling a portion of the second gas flow to create a thermally-induced temperature gradient in the second gas flow.

9. The method of claim 6, wherein the gas cell has a gas pressure of approximately 6894.76 Pascals or less or one pound per square inch or less.

10. An apparatus comprising:

a gas cell configured to receive a gas flow; and a cryocooler configured to cool a portion of the gas flow and create a thermally-induced temperature gradient in the gas flow axially along a length of the gas cell, wherein the cryocooler comprises a cold tip thermally coupled to the gas cell proximate to an end of the gas cell;

wherein the gas cell is configured to receive at least one laser beam axially along the length of the gas cell that passes through at least a portion of the gas flow with the thermally-induced temperature gradient.

11. The apparatus of claim 10, wherein the gas cell is configured to receive the gas flow axially along the length of the gas cell.

12. The apparatus of claim 10, wherein:

the gas flow comprises a first gas flow;

the gas cell is further configured to receive a second gas flow; and the cryocooler is further configured to cool a portion of the second gas flow and create a thermally-induced temperature gradient in the second gas flow.

13. The apparatus of claim 12, wherein the first gas flow and the second gas flow are directed axially along the length of the gas cell.

14. The apparatus of claim 10, wherein the gas cell has a gas pressure of one pound per square inch or less.

15. A system comprising:

the apparatus of claim 10; and at least one laser configured to generate the at least one laser beam;

wherein the gas cell and the cryocooler form at least part of an X-ray cell configured to receive the at least one laser beam and to generate X-rays.

16. An apparatus comprising:

a gas cell configured to receive a gas flow;

a cryocooler; and a heat exchanger configured to cool a portion of the gas flow and create a thermally-induced temperature gradient in the gas flow axially along a length of the gas cell, a central portion of the heat exchanger thermally coupled to the cryocooler;

wherein the gas cell is further configured to receive at least one laser beam axially along the length of the gas cell that passes through at least a portion of the gas flow with the thermally-induced temperature gradient.

17. The apparatus of claim 16, wherein the gas cell is configured to receive the gas flow transversely to the length of the gas cell.

18. The apparatus of claim 16, wherein:

the gas flow comprises a first gas flow;

the gas cell is further configured to receive a second gas flow; and the cryocooler is further configured to cool a portion of the second gas flow and create a thermally-induced temperature gradient in the second gas flow.

19. The apparatus of claim 16, wherein the gas cell has a gas pressure of approximately 6894.76 Pascals or less or one pound per square inch or less.

20. A system comprising:

the apparatus of claim 16; and at least one laser configured to generate the at least one laser beam;

wherein the gas cell and the cryocooler form at least part of an X-ray cell configured to receive the at least one laser beam and to generate X-rays.

* * * * *